US010263348B2

(12) United States Patent
Mundle

(10) Patent No.: US 10,263,348 B2
(45) Date of Patent: Apr. 16, 2019

(54) GROUNDING APPARATUS AND METHODS FOR GROUNDING

(71) Applicant: R U GROUNDED ENERGY INC., Penhold (CA)

(72) Inventor: Terry D. Mundle, Stony Plain (CA)

(73) Assignee: RU GROUNDED ENERGY INC., Penhold (CA)

( * ) Notice: Subject to any disclaimer, the term of this patent is extended or adjusted under 35 U.S.C. 154(b) by 24 days.

(21) Appl. No.: 15/588,660

(22) Filed: May 7, 2017

(65) Prior Publication Data

US 2017/0331203 A1 Nov. 16, 2017

Related U.S. Application Data

(60) Provisional application No. 62/334,233, filed on May 10, 2016.

(51) Int. Cl.
*H01R 4/00* (2006.01)
*H01R 4/66* (2006.01)

(52) U.S. Cl.
CPC ..... *H01R 4/66* (2013.01)

(58) Field of Classification Search
CPC ..... H05K 5/02; H01H 9/12; H01R 13/6596; H01R 4/64; H01R 9/0512; H01R 4/66; H02B 5/01
See application file for complete search history.

(56) References Cited

U.S. PATENT DOCUMENTS

| | | | | | |
|---|---|---|---|---|---|
| 2,531,183 | A * | 11/1950 | Wisner | H01R 4/66 | 174/6 |
| 2,683,765 | A * | 7/1954 | Luecke | H01R 4/66 | 174/6 |
| 6,331,927 | B1 * | 12/2001 | Overgaard | H05K 9/0067 | 361/212 |
| 2011/0096454 | A1 * | 4/2011 | Corsi | A01G 7/04 | 361/212 |
| 2011/0232174 | A1 * | 9/2011 | Mills | A01G 9/20 | 47/20.1 |
| 2017/0238478 | A1 * | 8/2017 | Brough | A01G 13/10 | |

* cited by examiner

*Primary Examiner* — Pete T Lee
(74) *Attorney, Agent, or Firm* — Donald V. Tomkins

(57) ABSTRACT

A method for electrically grounding structures or equipment includes providing an open-topped enclosure having peripheral sidewalls defining an interior cavity, positioning the enclosure over an in situ soil mass, placing a selected soil material in the cavity, and installing a grounding device in the soil contained in the cavity, so as to establish electrically-conductive continuity between the grounding device and the soil material in the cavity, and between the soil material in the cavity and the underlying in situ soil mass. Electrical cables can then be run between the grounding device and a structure or equipment to effect electrical grounding thereof. The effectiveness of the resultant electrical grounding may be enhanced by moistening the soil material in the enclosure and/or the in situ soil mass. The enclosure may have an open bottom, or may have a floor element with apertures allowing passage of moisture.

8 Claims, 4 Drawing Sheets

GROUNDING APPARATUS AND METHODS FOR GROUNDING

FIELD OF THE DISCLOSURE

The present disclosure relates in general to apparatus and methods for electrical grounding of structures and equipment, and relates in particular to such apparatus and methods for use in temporary applications where removal and recovery of grounding devices may be necessary or desirable, including but not limited to remote well sites and construction sites.

BACKGROUND

Known electrical grounding or ground fault protection (GFP) technologies commonly rely on electrically-conductive elements (i.e., electrodes) that are driven, augered, or buried a significant depth into the earth in order to effectively conduct electrical current into the earth. One example of such conductive elements is the commonly-used ground rod (or earth rod), which is typically driven or augered at least 8 feet into the earth to ensure that desired functional effectiveness is achieved. Alternative known GFP technologies use conductive elements in the form of ground mats that conduct electrical current to the ground by contacting the earth over a substantial interface area, with minimal if any ground penetration.

An ideal grounding connection maintains zero voltage regardless of how much electrical current flows into or out of the earth. The electrical resistance of the electrode-to-earth connection determines the quality or effectiveness of the grounding connection. More specifically, the lower the resistance, the more effective the grounding connection and resultant ground fault protection will be. Basic principles and conventional methods of electrical grounding and ground resistance measurement may be understood with reference to various publicly-available publications, including "Understanding Ground Resistance Testing" published by AEMC® Instruments (www.aemc.com).

The quality of a grounding connection may be improved in a number of ways, such as by: increasing the electrode surface area in contact with the earth; increasing the depth to which the ground rod is driven or augered (in cases where the electrode is a driven or augered ground rod); using multiple interconnected electrodes; increasing the moisture content of the earthen materials (soil) in the vicinity of the electrodes; improving the conductive mineral content of the earth; and/or increasing the ground surface area covered by the grounding apparatus.

The installation of driven or augered ground rods typically entails the use of specialized rod-driving or augering equipment, and even with the use of such equipment earth rod installation can be difficult due to soil conditions (for example, rock formations close to surface). Even when soil conditions are readily conducive to ground rod installation, the presence of buried utilities (e.g., gas lines, electrical power lines, water lines) can give rise to the risk of personal injury and/or the need for expensive utility repairs should such buried utilities be contacted or penetrated by ground rods during the ground rod installation process. These latter risks can be mitigated or avoided by the use of ground mats not having earth-penetrating elements, but such devices may have less than desired or optimal functional effectiveness.

BRIEF SUMMARY

The present disclosure teaches apparatus and methods for providing electrical grounding without penetrating the earth to any significant extent, or at all. One embodiment of grounding apparatus in accordance with the disclosure comprises an open-topped enclosure having peripheral sidewalls defining an interior cavity of desired depth. In some embodiments, a floor element may interconnect the lower regions of the sidewalls, with the floor preferably (but not necessarily) having at least one but preferably numerous apertures. In other variants, however, the enclosure may have an open bottom; i.e., with no floor element.

In embodiments having a floor element, the floor element optionally may be made from an electrically-conductive material, to enhance continuity of electrical conductivity between the soil in the enclosure cavity and the in situ soil materials underlying the enclosure. In one non-limiting variant, the floor element may be made from an expanded metal mesh. The floor element does not necessarily have to extend over the full area enclosed by the peripheral sidewalls. By way of non-limiting example, the floor element could comprise a lattice-like structure or a plurality of elongate elements (e.g., flat metal strips or bands extending between adjacent or opposing sidewalls).

One embodiment of a grounding method in accordance with the present disclosure involves the steps of positioning the enclosure on the ground (i.e., an earth surface), filling the cavity with a selected soil material, and installing a selected ground-penetrating grounding device in the soil contained in the cavity. In variant embodiments of this method, the grounding device may be positioned in the cavity prior to or concurrently with the introduction of the soil material into the cavity.

Examples of grounding devices suitable for use in conjunction with the presently-disclosed methods include devices disclosed in Canadian Patent No. 2,741,909, Canadian Patent No. 2,782,621, U.S. Pat. Nos. 8,420,929, and 9,083,171. However, other grounding devices may be used without departing from the scope of the present disclosure, and could include conventional ground rods of suitable size and quantity, and electrically interconnected as might be appropriate for job-specific requirements.

The quality of the grounding connection effected in accordance with this method may be enhanced by adding water to moisten the soil in the enclosure cavity. Water thus introduced into the soil in the cavity may seep into the in situ soil underlying the enclosure (through the apertures in the enclosure floor, if present), thereby providing enhanced electrical conductivity between the soil in the enclosure and the in situ soil beneath.

The height of the enclosure sidewalls (and hence the depth of the interior cavity) will be selected to ensure that the ground-penetrating elements of the selected grounding device do not penetrate the in situ soil below the enclosure beyond an allowable or acceptable depth, if at all, as may be dictated by case-specific requirements.

The enclosure may be configured to define a square or rectangular plan area (i.e., "footprint"), but other geometric configurations may be used in alternative embodiments, including enclosures having a circular or other curvilinear periphery as viewed in plan. For purposes of this disclosure, an enclosure having a circular or other curvilinear periphery is to be considered as constituting a plurality of sidewalls, notwithstanding that there might not be discrete delineations therebetween.

The peripheral sidewalls of the enclosure may be made partially or entirely from an electrically-conductive material, but this is not essential to all embodiments within the scope of the present disclosure.

However, embodiments having electrically-conductive sidewalls in electrical communication with an electrically-conductive floor element can be used for effective electrical grounding without needing to install a separate electrical grounding device in soil deposited in the enclosure cavity. Instead, grounding cables from a structure or equipment component to be grounded can be connected directly or indirectly to the electrically-conductive sidewall, thus establishing electrical continuity between the cables and the in situ soil under the enclosure, by virtue of the sidewalls and/or the floor element being in electrically-conductive contact with the soil within the enclosure and thereby with the in situ soil. Preferably, this electrical continuity with the in situ soil will be enhanced by moistening, by any suitable means, the soil within the enclosure and the in situ soil below the enclosure.

In embodiments where one or more sidewalls of the enclosure are electrically conductive, the sidewalls may be provided with suitable insulation for protection against electrical shock.

When the grounding method is used in cold-temperature conditions, a suitable heater may be fitted to the apparatus to prevent freezing of the grounding device (if present) and the soil materials within the enclosure. A weatherproof cover and/or thermal insulation may also be employed to protect the apparatus.

Accordingly, in one aspect the present disclosure teaches a method for electrically grounding a structure or equipment component by:

- providing an open-topped enclosure having peripheral sidewalls defining an enclosure cavity;
- positioning the enclosure over an in situ soil mass;
- placing a selected quantity of a selected soil material in the enclosure cavity, so as to establish electrically-conductive continuity between the soil material in the enclosure cavity and the in situ soil mass;
- installing a grounding device in the soil material in the enclosure cavity, so as to establish electrically-conductive continuity between the grounding device and the soil material in the enclosure cavity; and
- connecting an electrical cable between the grounding device and the structure or equipment component.

In a second aspect, the present disclosure teaches a method for electrically grounding a structure or equipment component by:

- providing an open-topped enclosure having peripheral sidewalls defining an enclosure cavity;
- positioning the enclosure over an in situ soil mass;
- placing a selected quantity of a selected soil material in the enclosure cavity, so as to establish electrically-conductive continuity between the soil material in the enclosure cavity and the in situ soil mass; and
- connecting an electrical cable between the structure or equipment component and grounding terminal means having electrically-conductive continuity with the soil material in the enclosure cavity.

In a third aspect, the present disclosure teaches a grounding apparatus comprising an open-topped enclosure having peripheral sidewalls defining an enclosure cavity, wherein the enclosure includes a floor element interconnecting adjacent or opposing sidewalls, and wherein the floor element has at least one aperture. Optionally, the floor element and one or more of the peripheral sidewalls may be made from an electrically-conductive material.

BRIEF DESCRIPTION OF THE DRAWINGS

Embodiments will now be described with reference to the accompanying Figures, in which numerical references denote like parts, and in which.

DETAILED DESCRIPTION

Figure 1:
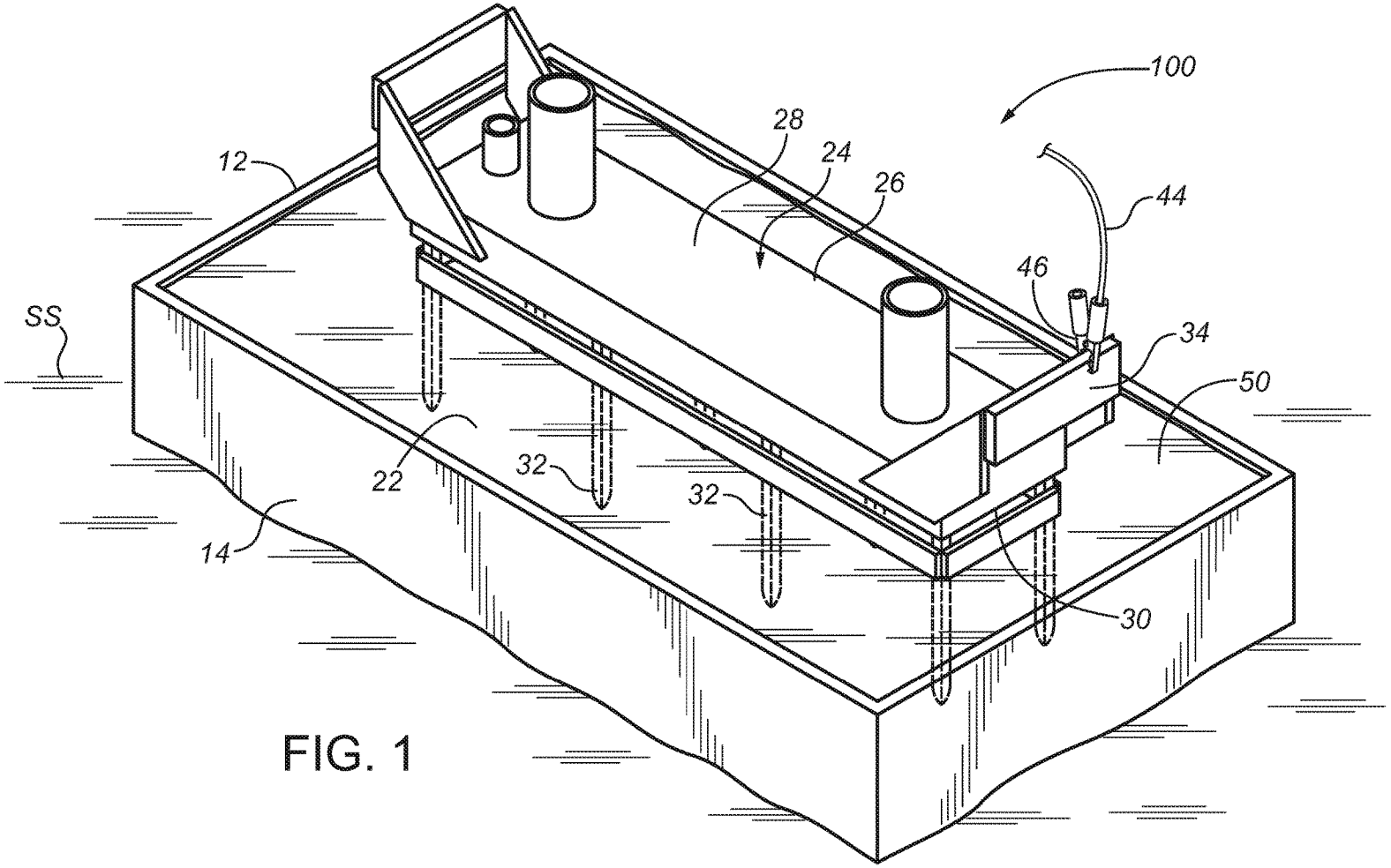
FIG. 1 is an isometric view of one embodiment of a grounding apparatus in accordance with the present disclosure.
Figure 2:
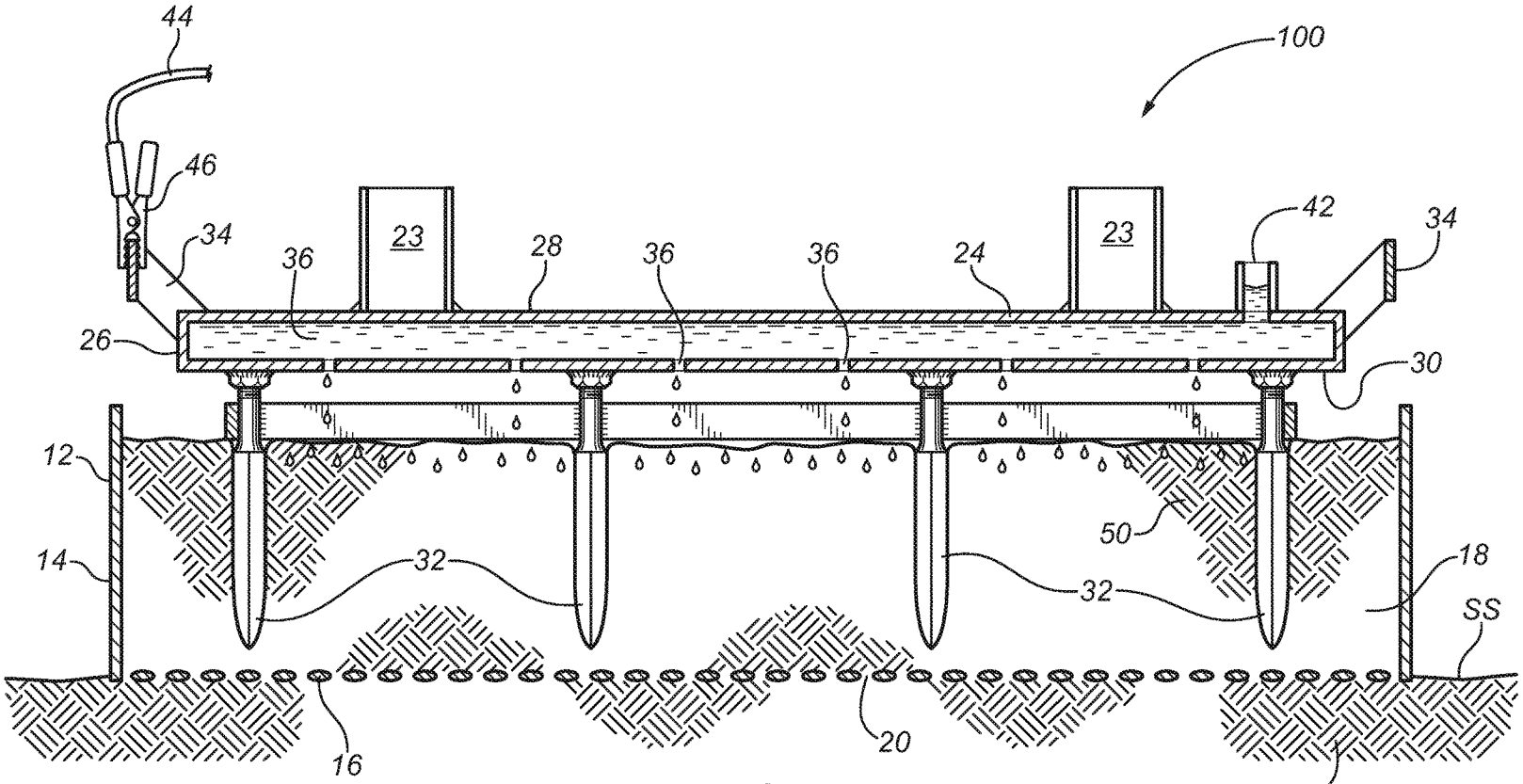
FIG. 2 is a cross-section through the grounding apparatus in FIG. 1.

FIGS. 1 and 2 illustrate an embodiment of a grounding apparatus 100 in accordance with the present disclosure. In the illustrated embodiment, grounding apparatus 100 comprises an enclosure 12 having peripheral sidewalls 14 defining an interior cavity 18. Optionally, a floor element 16 having at least one aperture 20 may interconnect adjacent and/or opposite sidewalls 14.

FIG. 2 illustrates grounding apparatus 100 in use in accordance with one method in accordance with the present disclosure, with enclosure 12 positioned over an in situ soil surface SS and with its interior cavity 18 filled with soil 50. A selected electrical grounding device 24 is shown installed with its electrodes 32 penetrating into the soil 50 within enclosure 12. The size and shape of enclosure 12 may be varied as appropriate to suit the particular type of grounding device 24 to be used with grounding apparatus 100. The grounding device 24 in the illustrated embodiment corresponds to a grounding device disclosed in U.S. Pat. No. 8,420,929, but this is by way of non-limiting example only, as embodiments in accordance with the present disclosure are not limited or restricted to use with any particular type of grounding apparatus or device.

Electrical conductivity established between the soil 50 within enclosure 12 and the underlying in situ soil mass SM makes it possible to install grounding means (such as grounding device 24) without penetrating or otherwise significantly disturbing the in situ soil mass SM. The conductivity between the soil 50 within enclosure 12 and the in situ soil mass SM can be enhanced by adding water to soil 50, and preferably in sufficient quantity such that some of the water can seep out of soil 50 (through apertures 20 in floor 16, if present) into the in situ soil mass SM, thus enhancing electrical continuity between soil 50 within enclosure 12 and the in situ soil mass SM below.

In the illustrated exemplary embodiment, grounding device 24 comprises a main body 26 having a top surface 28, a bottom surface 30, and a plurality of laterally-spaced electrodes 32 mounted to and extending downward from main body 26. Grounding device 24 may incorporate a water reservoir 36 and an inlet 42 for filling reservoir 36. Outlets 38 in the bottom of reservoir 36 allow water to drip into soil 50 contained in enclosure 12 to enhance electrical conductivity between electrodes 32 and soil 50. However, this is by way of non-limiting example only; it is not essential for grounding device 24 to include a water reservoir, as water can be added to soil 50, if desired, by any effective alternative means.

The exemplary grounding device 24 illustrated in the Figures includes at least one grounding terminal 34 in electrically-conductive communication with electrodes 32, to facilitate connection of grounding cables 44 from structures or equipment requiring either temporary or permanent electrical grounding. Grounding terminals 34 can be provided in any form functionally effective to establish electrical communication with electrodes 32. Grounding cables 44 may be connected to grounding terminals 34 by means of alligator clips 46 or any other functionally effective means for establishing an electrical connection between grounding cables 44 and electrodes 32 via grounding terminals 34 and main body 26 (including bolted connections).

Figure 3:
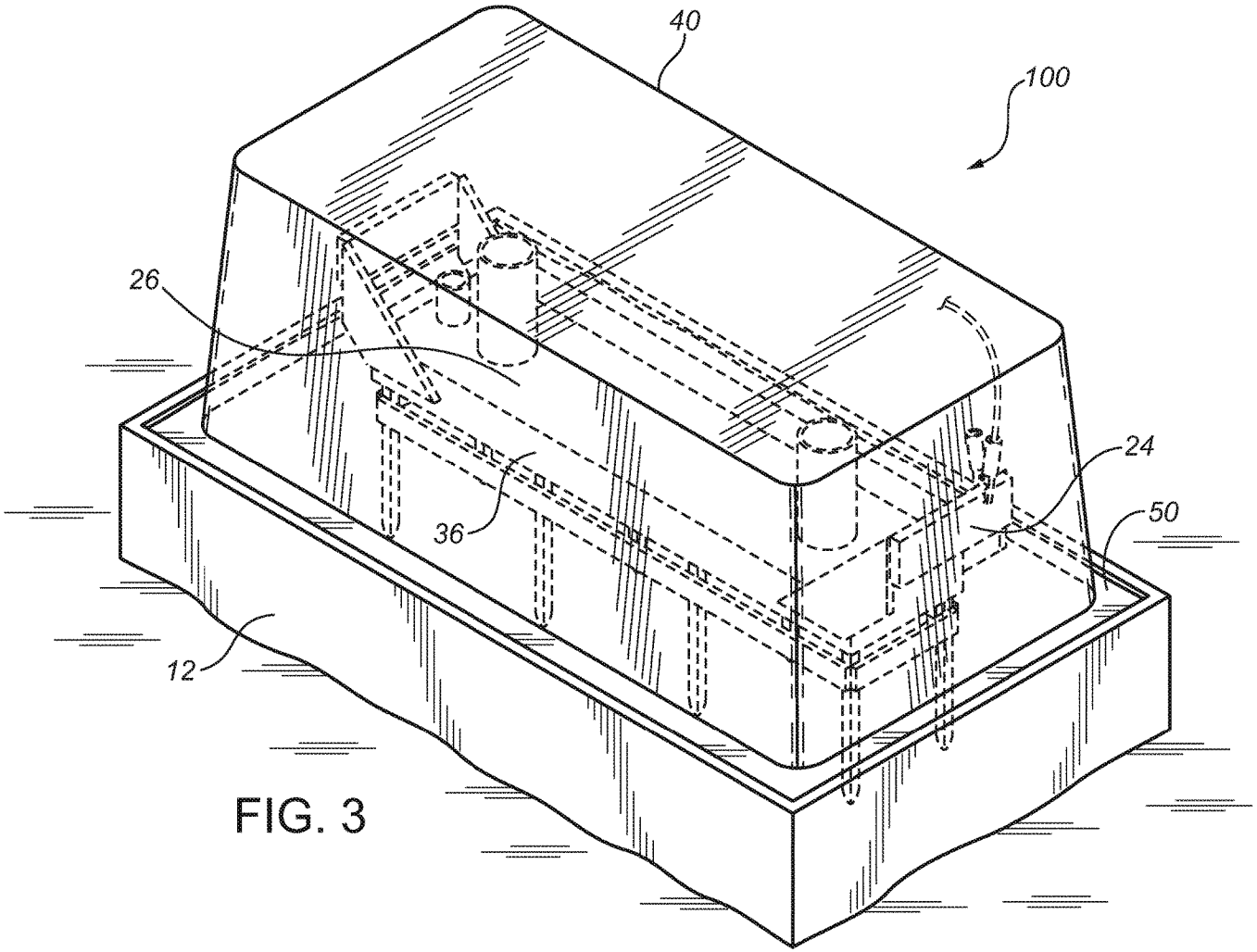
FIG. 3 is an isometric view of the grounding apparatus in FIG. 1, covered by a weatherproof cover.

As shown in FIG. 3, grounding device 24 may be provided with a weatherproof cover 40 as appropriate for the conditions in which grounding apparatus 100 is to be used. As well, a heater (not shown) may be provided (preferably in conjunction with a cover 40) to prevent freezing of soil in and around grounding device 24.

The method used to install the selected grounding device may vary according to the particular type of grounding device being used. When the illustrated grounding device 24 is used, main body 26 of grounding device 24 may be impacted either manually (such as by a sledge hammer) or mechanically (such as by the bucket of a backhoe or a front-end loader) to force electrodes 32 into the soil 50 within enclosure 12. Grounding device 24 optionally may incorporate impact abutments 23 to facilitate application of force to grounding device 24 for this purpose.

Figure 4:
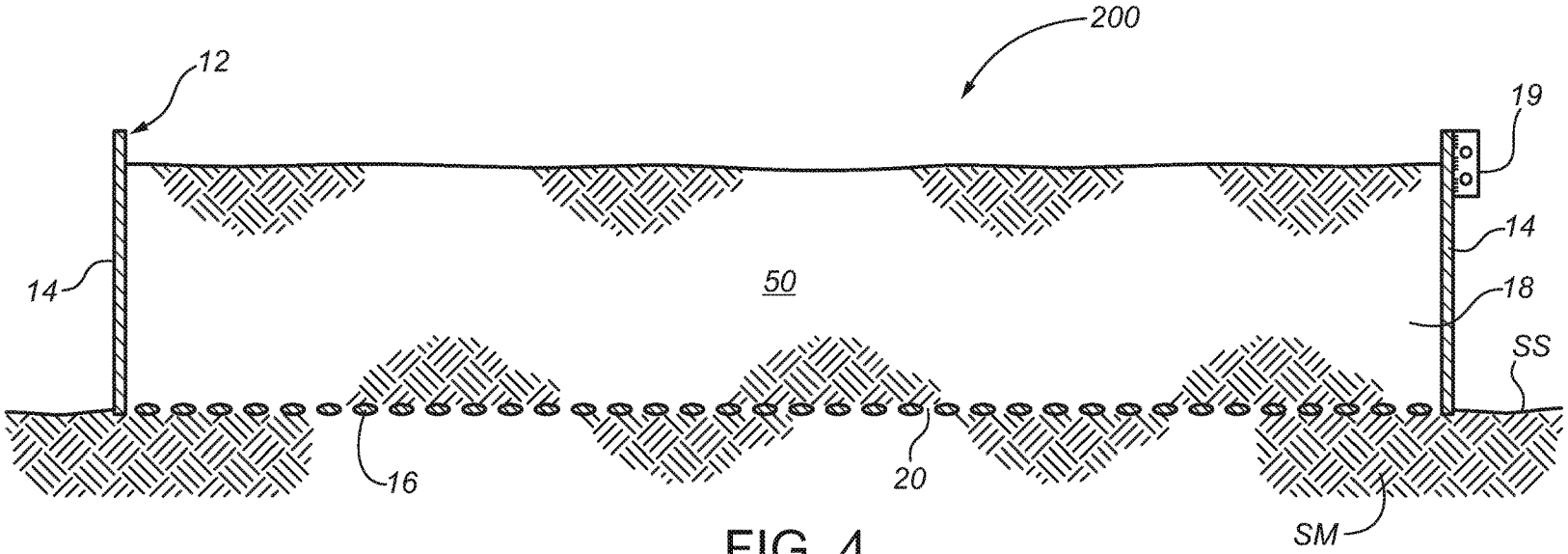
FIG. 4 is a cross-section through an alternative embodiment of a grounding apparatus in accordance with the present disclosure.

FIG. 4 illustrates an alternative embodiment of a grounding apparatus 200 in accordance with the present disclosure, in which enclosure 12 has one or more electrically-conductive perimeter sidewalls 14 and optionally may have a perforated or apertured floor element 16 (which optionally may be electrically conductive and in electrical communication with sidewalls 14). Enclosure 12 is positioned on the ground (i.e., earth) surface, and then a selected soil material 22 is deposited into cavity 18 of enclosure 12 (and compacted as may be appropriate). One or more grounding cables may be connected directly to electrically-conductive sidewall 14 of enclosure 12 of grounding apparatus 200 to establish electrical continuity between cables 44 and floor 16 and, thereby, with the in situ soil underlying enclosure 12. Alternatively, grounding cables could be connected to apparatus 200 by suitable terminal means such as (but not limited to) a conductive metal terminal plate 19 welded to sidewall 14 as shown in FIG. 4.

Preferably, the use of grounding apparatus 200 will moistening soil 18 as well as the in situ soil to enhance the effectiveness of the electrical continuity with the in situ soil. Although not specifically illustrated in the Figures, the use of this grounding method would appear generally as shown in FIG. 2 but without grounding device 24, and with grounding cable 44 connected to sidewall 14 (or to terminal plate 19).

In a variant of grounding apparatus 200, grounding cable 44 could be connected to grounding terminal means in electrical communication with an electrically-conductive floor element 16 and projecting above soil 50 in enclosure 12, or otherwise projecting from enclosure 12 to facilitate connection with grounding cable 44. In this variant embodiment, sidewalls 14 optionally could be made from a non-electrically-conductive material.

The soil 50 to be placed in cavity 18 of enclosure 12 of grounding apparatus 100 (or 200) may be selected taking into consideration the characteristics of the in situ soil mass SM over which apparatus 100 (or 200) is to be positioned. For example, in cases where the in situ soil mass SM is a porous soil (e.g., sand/gravel), soil 50 may be a similar porous material. In cases where the in situ soil mass SM is a cohesive (i.e., clayey) material, it may be beneficial to use a layered soil structure to facilitate controlled seepage of added moisture into soil 50 and the underlying in situ soil mass SM.

In one field test performed during the summer using grounding apparatus in accordance with the present disclosure over a moist clay in situ soil mass in Drayton Valley, Alberta, the following layered materials were placed in cavity 18 of enclosure 12:

- heavy-duty drainage cloth (over a perforated floor 16);
- a 6-inch layer of blue clay;
- a 12-inch layer of sand-mulch mixture over the clay layer;
- a 12-inch layer of lava rock; and
- a pattern of ¾-inch PVC piping placed over the clay layer (including at least one riser pipe extending above the clay layer), to facilitate controlled seepage of water into the clay layer and the underlying clayey in situ soil mass.

The optional drainage cloth over floor 16 prevents soil 50 from falling through apertures 20 in floor 16, and facilitates transportation and re-use of apparatus 100 (or 200) without removing soil materials from enclosure cavity 18. The lava rock layer and the sand-mulch layer reduce the total weight of the apparatus, thus further facilitating transportation and re-use.

The soil structure described above is by way of example only. The soil structure for installation in enclosure cavity 18 can be designed to control the rate of water flow as may be appropriate for a given installation. For example, the soil structure described above was designed to drain approximately 30 imperial gallons of at an initial rate of 10 gallons per hour after being initially filled with 60 gallons of water, and then to seep at a rate of 3 gallons per day.

In the Drayton Valley test, 60 imperial gallons of water were added to the apparatus after installation over the in situ clay soil mass, and electrical resistance was measured at 4.0 ohms. The apparatus was tested weekly throughout the summer, with no additional water added, and resistance was consistently measured at 3.6 ohms.

In another field test performed during late autumn (November/December) in Grande Prairie, Alberta, a grounding apparatus as above was positioned over a 50-year-old concrete floor, with a 3-inch layer of wet potting soil sandwiched between the concrete floor and floor 16 of the grounding apparatus. Resistance with this installation was measured at 18 ohms.

In a further field test, a grounding apparatus as above was installed over an in situ soil mass consisting of a hard-packed dirty gravel in the Grande Prairie area, and was then tested periodically between August and November. Measured resistance varied from 13 ohms in August to 30 ohms in November. Heat was then added to the apparatus (by circulating a heated fluid through the PVC tubing). In further tests made during December and January (while the underlying soil was frozen), resistance was measured between 30 ohms and 13 ohms.

It will be readily appreciated by those skilled in the art that various alternative embodiments of the disclosed grounding apparatus and methods may be devised without departing from the scope of the present teachings, including modifications that may use equivalent structures or materials subsequently conceived or developed. It is to be especially understood that it is not intended for grounding apparatus and methods in accordance with the present disclosure to be limited to any described or illustrated embodiment, and that the substitution of a variant of a claimed element or feature, without any substantial resultant change in the working of the apparatus and methods, will not constitute a departure from the scope of the disclosure.

In this patent document, any form of the word "comprise" is to be understood in its non-limiting sense to mean that any element or feature following such word is included, but elements or features not expressly mentioned are not excluded. A reference to an element by the indefinite article "a" does not exclude the possibility that more than one such element is present, unless the context clearly requires that there be one and only one such element. Any use of any form of the words "connect", "engage", "couple", "attach", or any other term describing an interaction between elements is not intended to limit that interaction to direct interaction between the subject elements, and may also include indirect interaction between the elements such as through secondary or intermediary structure.

In this document, the term "ground" is used in both noun and verb forms with reference to electrical grounding and electrical ground connections. The term "ground" may also be used herein with reference to earthen materials (e.g., soil) or a surface of the earth. The intended meaning of any form of the word "ground" in a given instance will be readily apparent to persons skilled in the art having due regard to the context in which it is used.

What is claimed is:

1. A method for electrically grounding a structure or equipment component, said method comprising the steps of:

(a) providing an open-topped enclosure having peripheral sidewalls defining an enclosure cavity and a floor element, wherein the floor element is made from an electrically-conductive material, and interconnects two or more adjacent or opposing sidewalls;

(b) positioning the enclosure over an in situ soil mass;

(c) placing a selected quantity of a selected soil material in the enclosure cavity, so as to establish electrically-conductive continuity between the soil material in the enclosure cavity and the in situ soil mass; and (d) connecting an electrical cable between the structure or equipment component and a grounding terminal having electrically-conductive continuity with the soil material in the enclosure cavity;

wherein:

(e) the grounding terminal is in electrical communication with the floor element and projects above the soil material in the enclosure cavity; and (f) one of the peripheral sidewalls is an electrically-conductive sidewall and serves as the grounding terminal.

2. A method as in claim 1 wherein the floor element has at least one aperture.

3. A method as in claim 1, comprising the further step of moistening the soil material in the enclosure cavity.

4. A method as in claim 1, comprising the further step of moistening the in situ soil mass.

5. A grounding apparatus for electrically grounding a structure or equipment component, said grounding apparatus comprising an open-topped enclosure having peripheral sidewalls defining an enclosure cavity, wherein the enclosure includes a floor element made from an electrically-conductive material interconnecting two or more adjacent or opposing sidewalls, wherein:

(a) the enclosure is positioned over an in situ soil mass;

(b) a selected quantity of a selected soil material is disposed within the enclosure cavity, so as to establish electrically-conductive continuity between the soil material in the enclosure cavity and the in situ soil mass; and (c) an electrical cable is connected between the structure or equipment component and a grounding terminal having electrically-conductive continuity with the soil material in the enclosure cavity;

(d) the grounding terminal is in electrical communication with the floor element and projects above the soil material in the enclosure cavity; and (e) one of the peripheral sidewalls is an electrically-conductive sidewall and serves as the grounding terminal.

6. A grounding apparatus as in claim 5 wherein the floor element has at least one aperture.

7. A grounding apparatus as in claim 5 wherein the soil mass in the enclosure cavity has been moistened.

8. A grounding apparatus as in claim 5 wherein the in situ soil mass has been moistened.

* * * * *